US005941364A

United States Patent [19]

Wei

[11] Patent Number: 5,941,364

[45] Date of Patent: Aug. 24, 1999

[54] COIN BOX ASSEMBLY

[75] Inventor: Ming-Shan Wei, Kaohsiung, Taiwan

[73] Assignee: Paokai Electronic Enterprise Co., Ltd., Kaohsiung, Taiwan

[21] Appl. No.: 09/222,771

[22] Filed: Dec. 30, 1998

[51] Int. Cl.[6] ..... G07F 9/06

[52] U.S. Cl. ..... 194/350; 232/16

[58] Field of Search ..... 194/350; 232/15, 232/16

[56] References Cited

U.S. PATENT DOCUMENTS

| | | | |
|---|---|---|---|
| 3,773,252 | 11/1973 | Jensen | 232/15 |
| 3,926,366 | 12/1975 | Sciortino | 232/15 |
| 4,638,746 | 1/1987 | Ishigure | 232/15 |
| 5,224,579 | 7/1993 | Brown | 232/16 |
| 5,873,446 | 2/1999 | Wei | 194/350 |

FOREIGN PATENT DOCUMENTS

| | | | |
|---|---|---|---|
| 4-281589 | 10/1992 | Japan | 194/350 |

*Primary Examiner*—F. J. Bartuska
*Assistant Examiner*—Bryan J. Jaketic
*Attorney, Agent, or Firm*—Bacon & Thomas

[57] ABSTRACT

A coin box assembly includes a coin box, a housing for removably receiving the coin box, and an affixing member to which the housing is connected. Mounted on the housing is an electromagnetic valve that engages with an engaging member on the coin box when the coin box is completely received in the housing. The engaging member activates a switch on the housing to send a signal of ready for receiving coins when the coin box is completely received in the housing. A block on a cover plate slidably mounted to the coin box is stopped by an actuating device on the housing such that move the cover plate is moved to a position covering a coin access in the coin box when removing the coin box from the housing. A latch on the cover plate engages with a latch catch in the coin box to close the coin box unless a lock mounted to the coin box is unlocked.

8 Claims, 5 Drawing Sheets

COIN BOX ASSEMBLY

BACKGROUND OF THE INVENTION

1. Field of the Invention

The present invention relates to a burglar-proof coin box assembly with a simplified, light structure.

2. Description of the Related Art

Coin boxes are widely used in pay phones, slot machines, vending machines, etc., and a long-existing problem thereof is that unauthorized persons may access the coin boxes. U.S. patent application Ser. No. 08/869,972 filed on Jun. 5, 1997 discloses a coin box assembly including a main housing and a coin box removably received in the main housing. The main housing includes a pair of rails to guide the coin box to a position completely received in the main housing. A locking means is mounted on the main housing to secure the coin box in this position. The coin box includes an upper lid assembly which has a fixed plate and a movable door plate biased away from the fixed plate such that an upper opening of the coin box is in a normally open position for receiving coins. The main housing further includes a coin access defined in an upper plate thereof and in alignment with the upper opening of the coin box when the coin box is completely received in the main housing. When removing the coin box from the main housing, the stop of the movable door plate is moved across an electromagnetic valve mounted on the coin box such that the door plate is moved toward the fixed plate and thus blocks the upper opening of the coin box. The stop of the door plate is securely engaged with the electromagnetic valve after the stop has been moved across the electromagnetic valve to still block the upper opening of the coin box. It is, however, found that the lock is apt to be destroyed, as the lock is located in the open end of the main housing. In addition, the rails of the main housing and grooves in the coin box result in a high cost in manufacture. In addition, an empty coin box is required to replace with the coin box filled with coins, the cost is high and the transportation is inconvenient, as each empty coin box must be equipped with an electromagnetic valve.

The present invention is intended to provide an improved coin box assembly that mitigates and/or obviates the above drawbacks.

SUMMARY OF THE INVENTION

It is a primary object of the present invention to provide an improved coin box assembly that is light and simplified in structure to lower the cost.

A coin box assembly in accordance with the present invention comprises:

- a coin box including a chamber defined therein, a latch catch formed thereon, a locking means mounted to a first end thereof, and a first engaging member mounted to a second end thereof;
- an upper lid removably mounted on top of the coin box for opening and closing the coin box, the upper lid including a second engaging member mounted thereon for releasably engaging with the locking means, the upper lid further including a coin access defined therein and two sliding grooves respectively defined in two lateral sides thereof;
- a cover plate slidably received in the sliding grooves of the upper lid and movable between a first position covering the coin access and a second position not covering the coin access, the cover plate including a block formed on an upper side thereof and a latch formed on an underside thereof;

- a housing for removably receiving the coin box, the housing including an electromagnetic valve mounted to an end thereof for releasably engaging with the first engaging member of the coin box when the coin box is completely received in the housing, thereby preventing removal of the coin box from the housing, the housing further including a collecting opening defined in an upper side thereof and aligned with the coin access when the coin box is completely received in the housing, an actuating means being mounted on the upper side of the housing, wherein the actuating means allows the block of the cover plate to pass through when the coin box is moved into the housing, and wherein the actuating means stops the block when the coin box is moved away from the housing to move the cover plate from the second position not covering the coin access to the first position covering the coin access, while the latch is moved to engage with the latch catch such that the upper lid is closed unless the locking means is unlocked.

An affixing member is connected to the housing and includes a coin slot through which coins inserted through the coin slot are collected in the coin box after passing through the collecting opening and the coin access. The affixing member further includes a first socket for releasably engaging with an electric key and a second socket connected to a power source. The electromagnetic valve is activated to disengage from the first engaging member of the coin box to allow removal of the coin box from the housing if the electric key is engaged with the socket and identified. The electric key may access detailed information of coin insertion of the coins to check the quantity of the coins in the coin box.

The coin box may include a hinge for pivotal connection with the upper lid. Two springs are attached between the upper lid and the cover plate to bias the cover plate to the second position not covering the coin access. In addition, the housing may provide an inclined surface in a bottom thereof to guide movements of the coin box in the housing during removal or insertion of the coin box.

The coin box includes a partition member that separates the chamber into an inner chamber and an outer chamber, and wherein the coins are collected in the outer chamber.

A first switch is mounted to the housing and is activated by the actuating means to send a signal of insertion of the coin box into the housing. Also mounted on the housing is a second switch that is activated by the first engaging member to send a first signal of ready for receiving coins when the coin box is completely received in the housing. The second switch sends a second signal indicating that the coin box is in a non-operating status and unable to receive coins when the first engaging member disengages from the switch.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
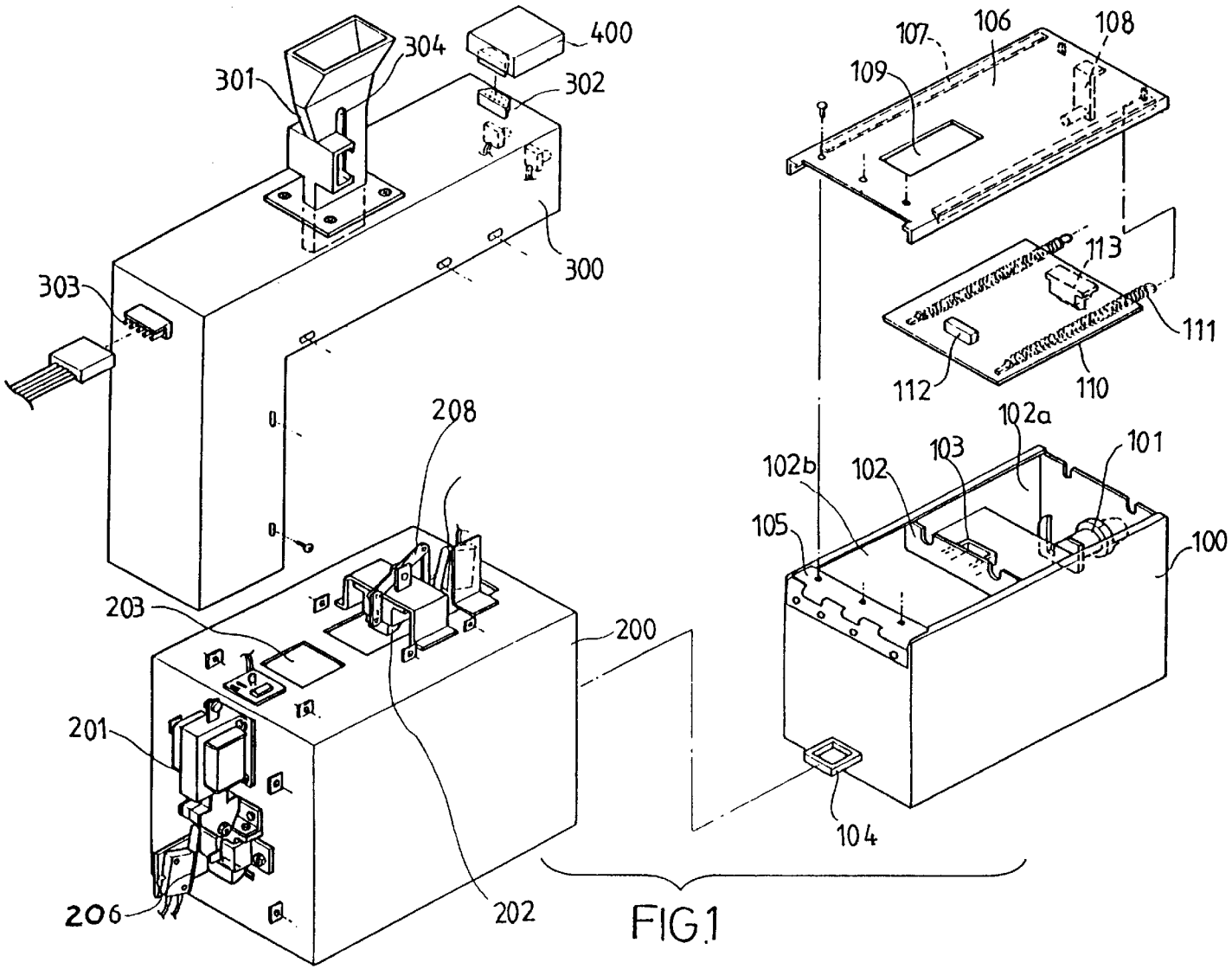
FIG. 1 is an exploded perspective view of a coin box assembly in accordance with the present invention.
Figure 3:
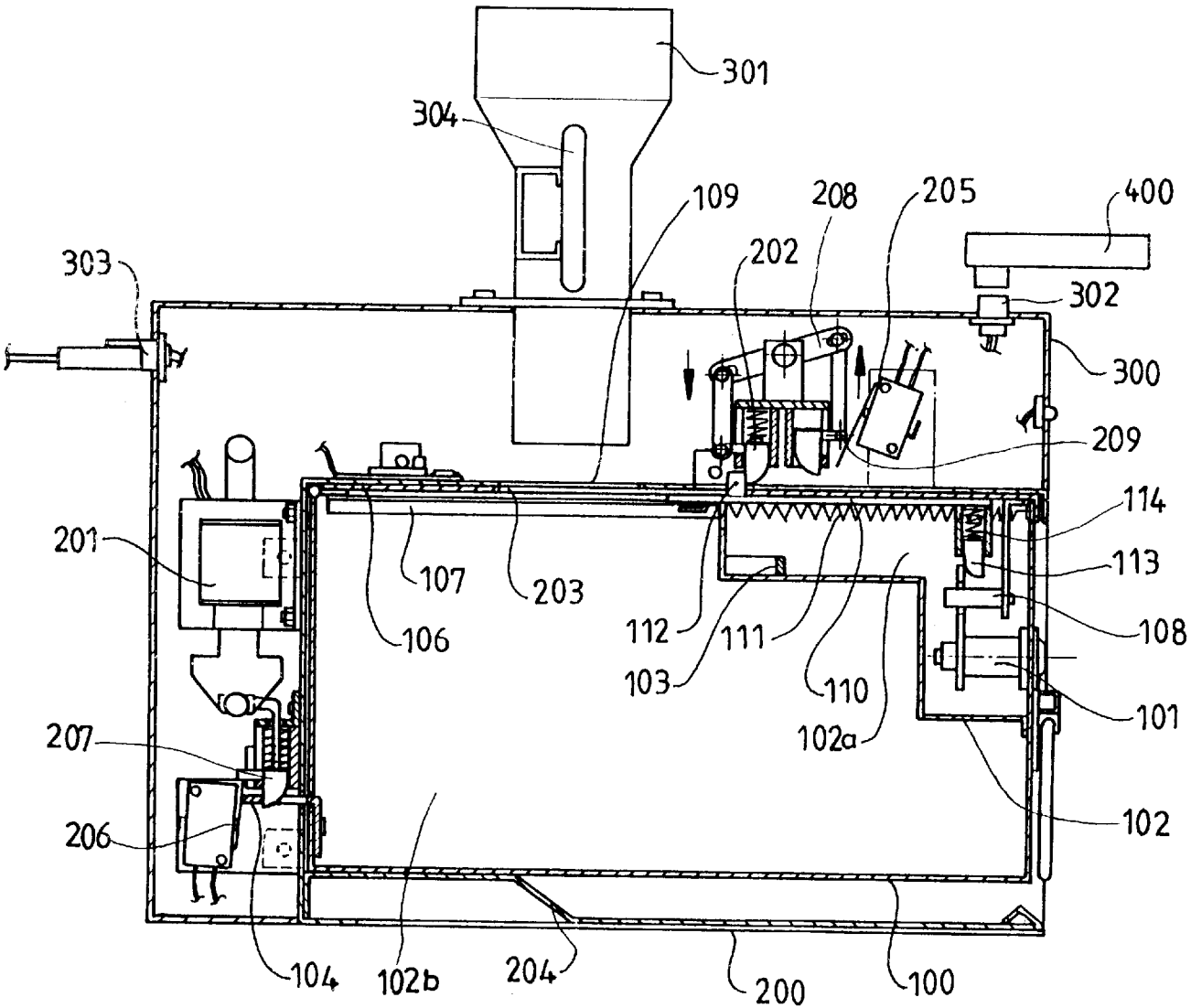
FIG. 3 is a sectional view similar to FIG. 2, wherein the coin box is in a position ready for receiving coins.

Referring to the drawings and initially to FIGS. 1 and 3, a coin box assembly in accordance with the present invention generally includes a coin box 100, a housing 200 for receiving the coin box 100, and an affixing member 300 to which the housing 200 is connected.

Figure 5:
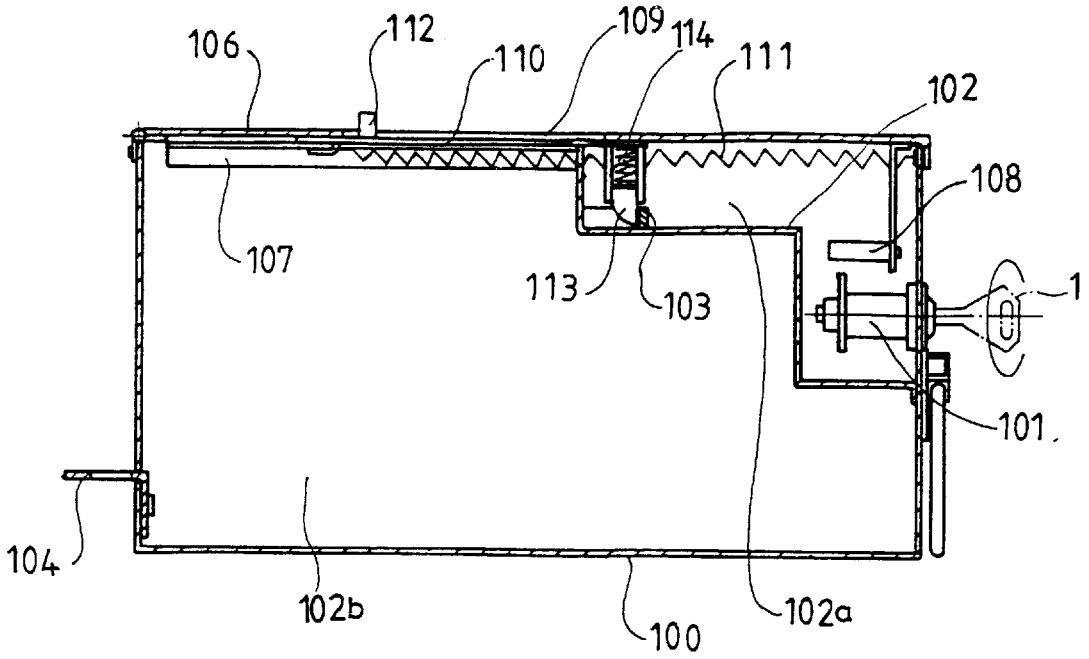
FIG. 5 is a sectional view of the coin box in a locked status.
Figure 6:
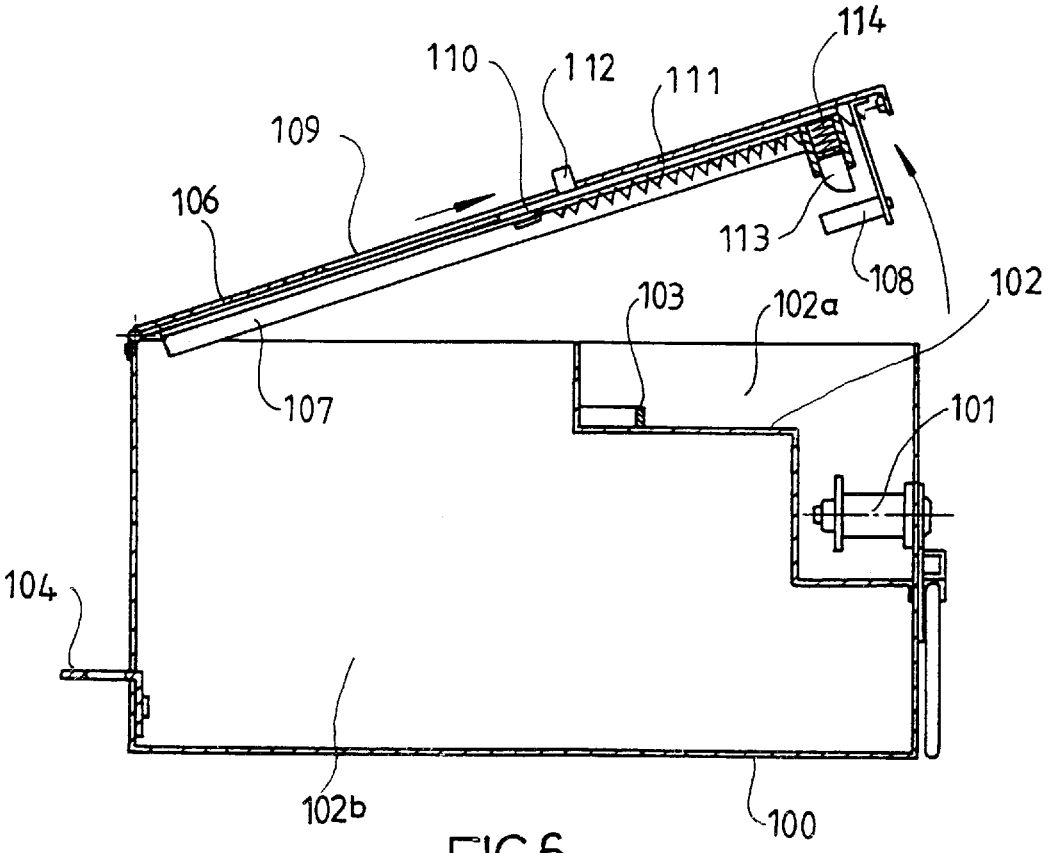
FIG. 6 is a sectional view of the coin box in an unlocked status.

Still referring to FIGS. 1 and 3, the coin box 100 includes a locking means 101 mounted to a first end thereof. It is appreciated that the locking means 101 is smaller and lighter than the electromagnetic valve disclosed in U.S. patent application Ser. No. 08/969,972. The coin box 100 includes a chamber 102 defined therein and a partition member 102 that separates the chamber 102 into an inner chamber 102*a* and an outer chamber 102*b*. A latch catch 103 is mounted in the inner chamber 102*a*. A second end of the coin box 100 includes a hinge 105 for pivotally connecting an end of an upper lid 106 to allow opening/closing of the coin box 100. In addition, an engaging member 104 is mounted to the second end of the coin box 100, which will be described later. The other end of the upper lid 106 includes an engaging member 108 for releasably engaging with the locking member 101. The upper lid 106 further includes a sliding groove 107 defined in each lateral side thereof for slidably receiving a cover plate 110. The locking means 101 engages with the engaging member 108 of the upper lid 106 when the coin box 100 is in a locked (i.e., closed) status. The upper lid 106 further includes a coin access 109 defined therein through which coins are passable into the outer chamber 102*b*. Two springs 111 are attached between the cover plate 110 and the upper lid 106 for biasing the cover plate 110 to a position covering the coin access 109 when the coin box 100 is removed from the housing 200, which will be further described later. The cover plate 110 further includes a block 112 on an upper side thereof and a spring-biased latch 113 on an underside thereof. When the coin box 100 is in the closed status, the latch 113 extends downwardly under the action of the spring 114 to engage with the latch catch 103 when the block 112 on the cover plate 110 is moved to the position covering the coin access 109. As a result, the coin box 100 remains closed unless a proper key is used to unlock the locking means 101 (FIG. 5). When the upper lid 106 is opened, the springs 111 retract the cover plate 110 to a normally open position not covering the coin access 109 (FIG. 6).

Referring to FIGS. 1 and 3, the housing 200 includes a compartment (not labeled) for receiving the coin box 100. An electromagnetic valve 201 and a switch 206 are mounted to a side of the housing 200. In addition, a switch 205 and an actuating means (e.g., a lever device 208) are mounted to an upper side of the housing 200. Operations of these elements will be described later. A collecting opening 203 is defined in the upper side of the housing 200 and aligns with the outer chamber 102*b* of the coin box 100. The affixing member 300 includes a coin insertion device 301 with a coin slot 304 through which coins are passable to the collecting opening 203 of the housing 200. A socket 302 is mounted on the affixing member 300. An electric key 400 may be engaged with the socket 302, and the electromagnetic valve 201 will be activated to disengage from the engaging member 104 if the electric key 400 is identified, thereby allowing removal of the coin box 100 from the housing 200. Also mounted to the affixing member 300 is a socket 303 that is connected to a power source for power supply. The detailed information of insertion of the coins may be accessed by the electric key 400 for checking the quantity of the coins in the coin box 100.

Figure 2:
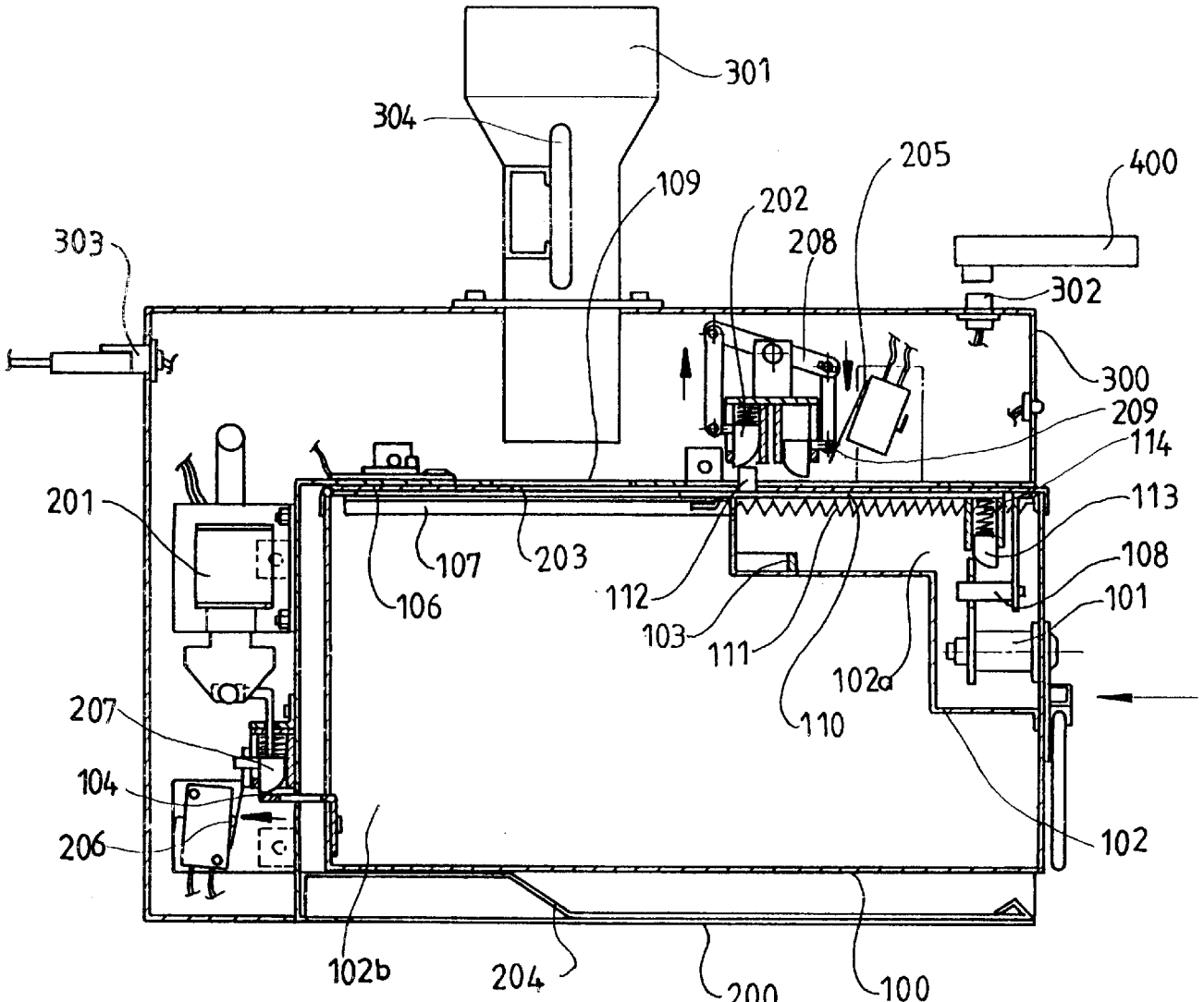
FIG. 2 is a schematic sectional view of the coin box assembly, illustrating insertion of the coin box.

The coin box 100 in FIG. 2 is to be inserted into the housing 200, the springs 111 bias the cover plate 110 to the normally open position not covering the coin access 109. A bottom of the coin box 100 is guided by an inclined surface 204 of the housing 200 such that the block 112 actuates a first end 202 of the lever device 208. As a result, a second end 209 of the lever device 208 activates the switch 205. The switch 205 sends a signal of insertion of the coin box 100 to the machine (not shown) equipped with the coin box assembly of the present invention. At this time, the engaging member 104 contacts with an actuator 207 the electromagnetic valve 201. Referring to FIG. 3, when the coin box 100 is completely received in the housing 200, the engaging member 104 engages with the actuator 207 of the electromagnetic valve 201 such that the coin box 100 cannot be removed from the housing 200. The engaging member 104 also activates the switch 206 to identify that the coin box 100 is in a position ready for receiving coins. The coin access 109 aligns with the collecting opening 203 of the housing 200. Thus, coins inserted through the coin slot 304 are collected in the outer chamber 102*b* of the coin box 100.

Figure 4:
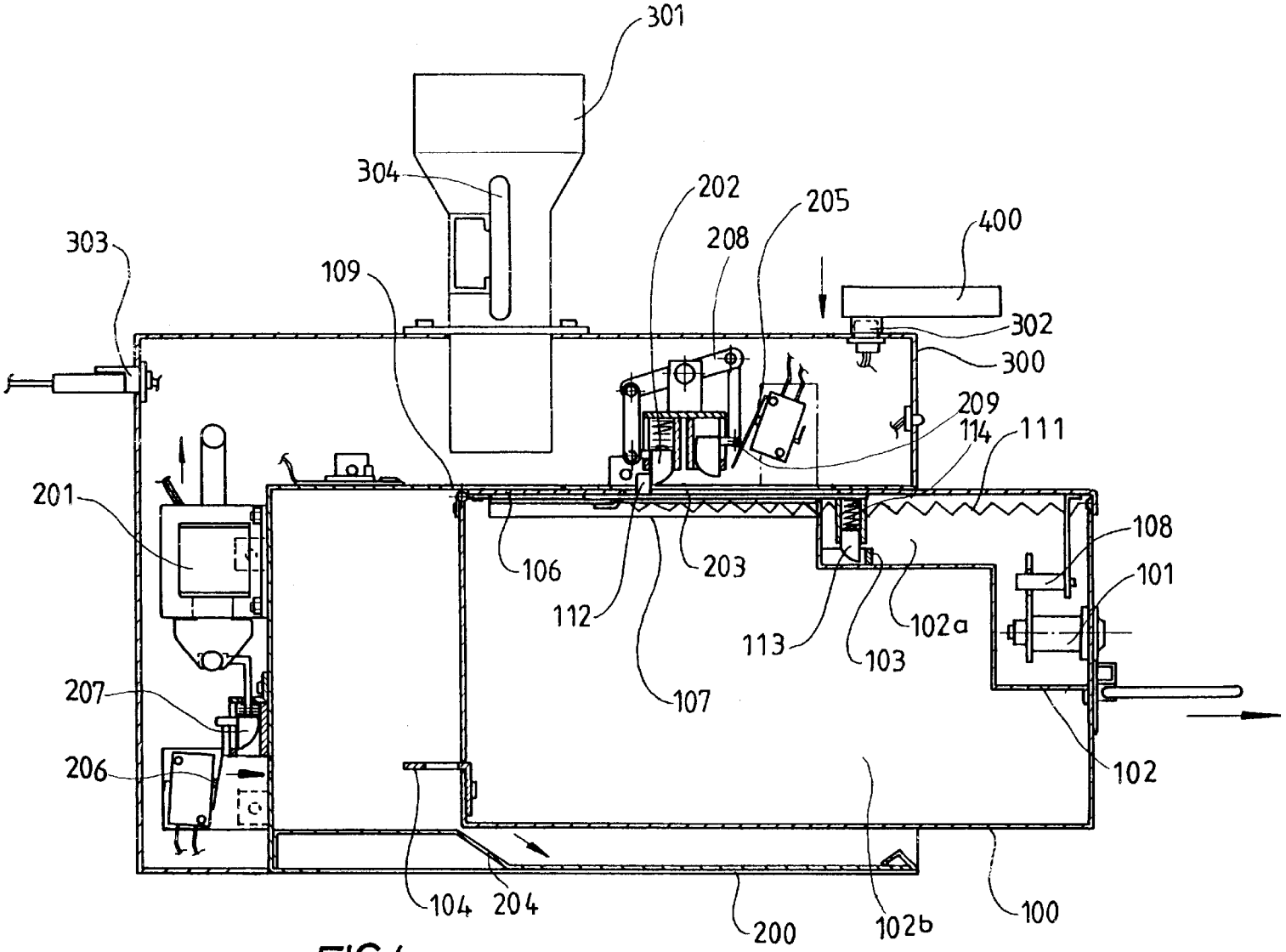
FIG. 4 is a sectional view similar to FIG. 2, illustrating removal of the coin box.

Referring to FIG. 4, when a person in charge of the coin box 100 engages the electric key 400 with the socket 302, and if the electric key 400 is identified, the electromagnetic valve 201 is activated such that the actuator 207 disengages from the engaging member 104 to allow removal of the coin box 100 from the housing 200. The detailed information of insertion of the coins may be accessed by the electric key 400 for checking the quantity of the coins in the coin box 100. The switch 206, after disengagement with the engaging member 104, sends a signal of not ready for receiving coins to the machine, and the machine will be in a non-operating status and unable to receive coins. Nevertheless, during removal of the coin box 100, the block 112 on the cover plate 110 is stopped by the first end 202 of the lever device 208 such that the cover plate 110 remains in place. As a result, the cover plate 110 is moved to the position covering the coin access 109, while the latch 113 engages with the latch catch 103, as shown in FIG. 4. The coin box 100 moves downwardly under the guidance of the inclined surface 204 of the housing 200 and then removed from the housing 200.

As shown in FIG. 5, the latch 113 still engages with the latch catch 103 when the coin box 100 is removed from the housing 200, while the coin access 109 is covered by the cover plate 110. When a proper key 1 is used to unlock the locking means 101, the engaging member 108 disengages from the locking means 101 and thus allows opening of the coin box 100 by opening the upper lid 106, best shown in FIG. 6. The coins in the coin box 100 are now removable. The cover plate 110 returns to the normally open position not covering the access 109 under the action of the springs 111 such that the coin box 100 may be in a status for receiving coins if the upper lid 106 re-engages with the coin box 100.

Although the invention has been explained in relation to its preferred embodiment, it is to be understood that many other possible modifications and variations can be made without departing from the spirit and scope of the invention as hereinafter claimed.

What is claimed is:

1. A coin box assembly comprising:

a coin box including a chamber defined therein, a latch catch formed thereon, a locking means mounted to a first end thereof, and a first engaging member mounted to a second end thereof;

an upper lid removably mounted on top of the coin box for opening and closing the coin box, the upper lid including a second engaging member mounted thereon for releasably engaging with the locking means, the upper lid further including a coin access defined therein and two sliding grooves respectively defined in two lateral sides thereof;

a cover plate slidably received in the sliding grooves of the upper lid and movable between a first position covering the coin access and a second position not covering the coin access, the cover plate including a block formed on an upper side thereof and a latch formed on an underside thereof;

a housing for removably receiving the coin box, the housing including an electromagnetic valve mounted to an end thereof for releasably engaging with the first engaging member of the coin box when the coin box is completely received in the housing, thereby preventing removal of the coin box from the housing, the housing further including a collecting opening defined in an upper side thereof and aligned with the coin access when the coin box is completely received in the housing, an actuating means being mounted on the upper side of the housing, wherein the actuating means allows the block of the cover plate to pass through when the coin box is moved into the housing, and wherein the actuating means stops the block when the coin box is moved away from the housing to move the cover plate from the second position not covering the coin access to the first position covering the coin access, while the latch is moved to engage with the latch catch such that the upper lid is closed unless the locking means is unlocked.

2. The coin box assembly as claimed in claim 1, further comprising an affixing member connected to the housing and including a coin slot through which coins inserted through the coin slot are collected in the coin box after passing through the collecting opening and the coin access.

3. The coin box assembly as claimed in claim 2, wherein the affixing member further includes a socket for releasably engaging with an electric key, wherein the electromagnetic valve is activated to disengage from the first engaging member of the coin box to allow removal of the coin box from the housing if the electric key is engaged with the socket and identified.

4. The coin box assembly as claimed in claim 3, wherein the electric key accesses detailed information of the coin insertion.

5. The coin box assembly as claimed in claim 1, wherein the coin box includes a hinge for pivotal connection with the upper lid.

6. The coin box assembly as claimed in claim 1, wherein the coin box includes a partition member that separates the chamber into an inner chamber and an outer chamber, and wherein the coins are collected in the outer chamber.

7. The coin box assembly as claimed in claim 1, wherein the housing includes a switch mounted thereto, and wherein the switch is activated by the actuating means to send a signal of insertion of the coin box into the housing.

8. The coin box assembly as claimed in claim 1, wherein the housing includes a switch mounted thereto, and wherein the switch is activated by the first engaging member to send a first signal of ready for receiving coins when the coin box is completely received in the housing, and the switch sends a second signal indicating that the coin box is in a non-operating status and unable to receive coins when the first engaging member disengages from the switch.

* * * * *